United States Patent [19]

Lepley

[11] Patent Number: 4,880,195

[45] Date of Patent: Nov. 14, 1989

[54] BANNER SUPPORT

[75] Inventor: Roger M. Lepley, Kalamazoo, Mich.

[73] Assignee: Kalamazoo Banner Works, Inc., Kalamazoo, Mich.

[21] Appl. No.: 283,062

[22] Filed: Dec. 9, 1988

[51] Int. Cl.[4] ..... A47B 96/00

[52] U.S. Cl. ..... 248/219.4; 40/607; 248/219.3

[58] Field of Search ..... 248/219.4, 219.1, 219.3, 248/218.4, 220.2, 230, 231; 40/607

[56] References Cited

U.S. PATENT DOCUMENTS

| | | | |
|---|---|---|---|
| 4,101,191 | 7/1978 | Gould et al. | 248/219.3 X |
| 4,548,377 | 10/1985 | Huel | 248/219.1 |
| 4,801,115 | 1/1989 | Heard | 248/219.3 |

*Primary Examiner*—Ramon O. Ramirez

*Attorney, Agent, or Firm*—Flynn, Thiel, Boutell & Tanis

[57] ABSTRACT

A banner support assembly adapted to be mounted on a supporting member for purposes of engaging and holding taut an elongated banner having sleeve-like openings in the opposite longitudinal ends thereof. The banner support assembly includes first and second housing members each having a body with an elongated T-shaped channel opening outwardly of the body along a front face and at least one end thereof. Each T-shaped channel has an abutment member at the other end of the channel. The first and second housing members are adapted to be mounted a prescribed distance apart on the supporting member and with each longitudinal axis of each T-shaped channel being axially aligned and with the openings in the at least one ends thereof facing in the same direction. First and second holder members are provided having a generally T-shaped cross section conformed to the cross-sectional shape of the T-shaped channels and being adapted to be received in a respective one of the T-shaped channels through the openings in the aforesaid at least one ends thereof. An elongated and elastically flexible wand is fixedly secured to each holder member and, when the holder member is mounted on the housing member, is adapted to extend outwardly away from the housing member through the opening in the front face of the housing member. The wands are each adapted to be received in a selected one of the two sleeve-like openings in the banner. The length of the banner being generally equal to a spacing between the wands whereat the wands are joined to the holder members when the holder members both abut the abutment members.

11 Claims, 3 Drawing Sheets

BANNER SUPPORT

FIELD OF THE INVENTION

This invention relates to a banner support assembly adapted to be mounted on a supporting member for purposes of engaging and holding taut an elongated banner having sleeve-like openings in the opposite longitudinal ends thereof.

BACKGROUND OF THE INVENTION

A metropolitan area will often times prefer to advertise to the public the existence of certain activities that are ongoing within the community. Many times, the metropolitan area will place banners or the like onto light poles and other types of supporting members, which banners display art work commemorating the event happening within the community. Bracket structures have heretofore been developed for holding the banners taut and which are capable of withstanding certain wind loads applied thereto. However, as the wind loads, heat and cold continuously apply and then relax loads to the banner, the banner supporting structure is stressed and then relaxed periodically as the days go by. Oftentimes, fasteners and the like will be loosened by the repeated loads applied to the banner supporting structure by the changes in weather to cause the banner supporting structure to become loosened and eventually disengaged from the light pole and other types of supporting surfaces. Thus, a need has arisen for the provision of a reliable banner support assembly which makes mounting the banners onto supporting members easy and yet provides the requisite durability and reliability of maintaining the banner adequately supported and taut on the supporting member.

Accordingly, it is an object of the present invention to provide a banner support assembly which facilitates a mounting of a banner on a supporting member with a minimum of difficulty, but yet with reliability that the banner so mounted will remain on the supporting member and will not become disengaged therefrom due to repeated loadings by wind and the other elements of weather acting on the banner supported by the banner support assembly.

It is a further object of the invention to provide a banner support assembly, as aforesaid, which has the requisite flexibility to allow wind loads applied to the banner to spill before any over stressing of the banner support assembly occurs.

It is a further object of the invention to provide a banner support assembly, as aforesaid, which allows rapid mounting of a banner onto a supporting member with a minimum of difficulty.

It is a further object of the invention to provide a banner support assembly, as aforesaid, which is composed of, other than fastening hardware, four component parts, that is, two sets of two parts which are identical, two parts of one set of which are adapted to be mounted in a spaced relation on a supporting member and the remaining two parts of the other set are each adapted to slide into engaging relation with the first mentioned part and fastened thereto.

SUMMARY OF THE INVENTION

The aforementioned objects and purposes have been met by providing a banner support assembly adapted to be mounted on a supporting member for purposes of engaging and holding taut an elongated banner having sleeve-like openings in the opposite longitudinal ends thereof. The banner support assembly includes first and second housing members each having a body with an elongated T-shaped channel opening outwardly of the body along a front face and at at least one end thereof. Each T-shaped channel has an abutment member at the other end of the channel. The first and second housing members are adapted to be mounted a prescribed distance apart on the supporting member and with each longitudinal axis of each T-shaped channel being axially aligned and with the openings in the at least one ends thereof facing in the same direction. First and second holder members are provided having a generally T-shaped cross section conformed to the cross-sectional shape of the T-shaped channels and being adapted to be received in a respective one of the T-shaped channels through the openings in the aforesaid at least one ends thereof. Each of the holder members has at least first and second ends with a selected one of the ends adapted to rest against a respective one of the abutment members. An elongated and elastically flexible wand is fixedly secured to each holder member and, when the holder member is mounted on the housing member, is adapted to extend outwardly away from the housing member through the opening in the front face of the housing member. The wands are each adapted to be received in a selected one of the two sleeve-like openings in the banner. The length of the taut banner is generally equal to a spacing between the wands whereat the wands are joined to the holder members when the holder members both abut the abutment members.

BRIEF DESCRIPTION OF THE DRAWINGS

Other objects and purposes of the invention will become apparent to persons having skill in the art by reading the following specification and inspecting the accompanying drawings, in which.

Certain terminology will be used in the following description for convenience in reference only and will not be limiting. The words "in" and "out" will refer to directions toward and away from, respectively, the geometric center of the device and designated parts thereof. The words "up" and "down" will indicate directions relative to the horizontal and as depicted in the various figures. Such terminology will include the words above specifically mentioned, derivatives thereof and words of similar import.

DETAILED DESCRIPTION

Figure 1:
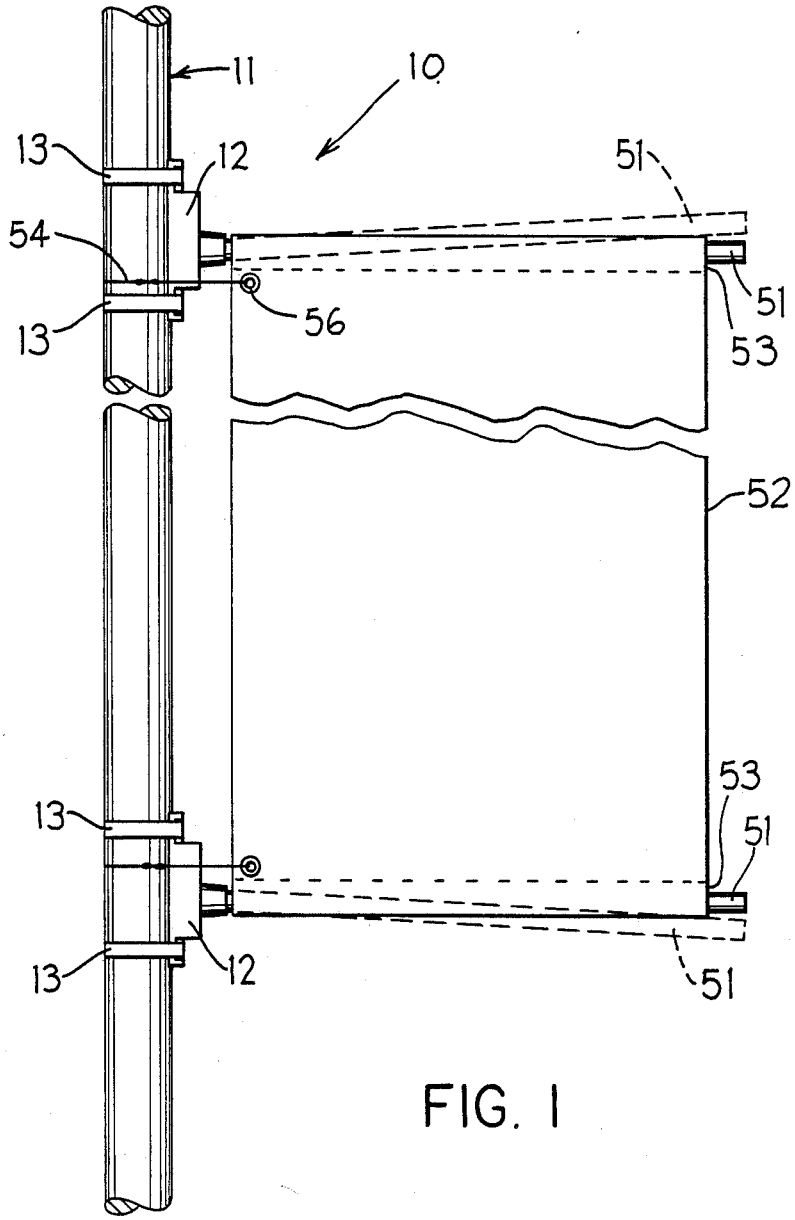
FIG. 1 is a side elevational view of a banner support assembly embodying the invention.
Figure 3:
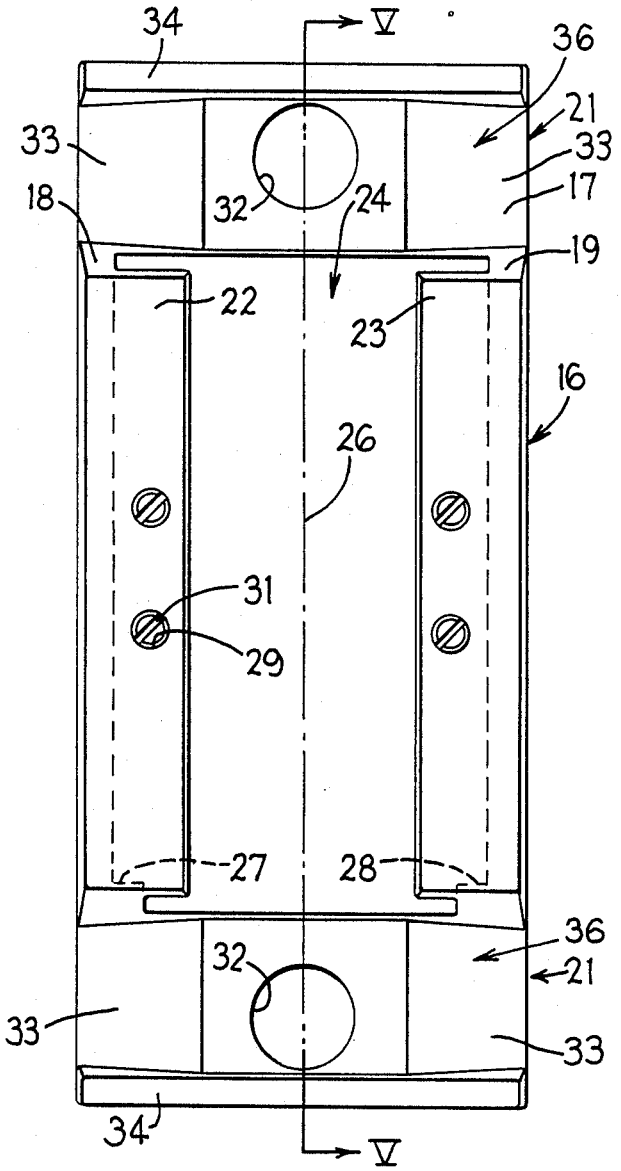
FIG. 3 is an enlarged front elevational view of a housing member.
Figure 4:
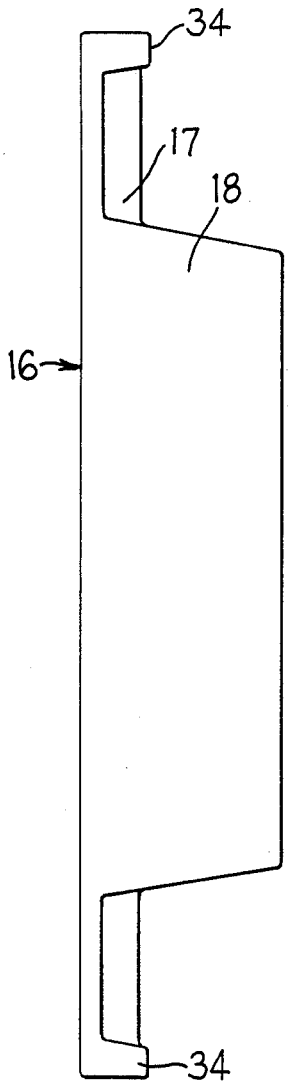
FIG. 4 is a side elevational view of the housing member.

A banner support assembly 10 is illustrated in FIG. 1 and includes a supporting member 11, such as a municipal light pole, a telephone pole or other vertically upright standing members. The supporting member 11 can also be a flat planar wall surface. The banner support assembly 10 includes a pair of spaced housing members 12 secured to the supporting member 11 by either flexible banding 13 or bolts, such as the bolts 14 shown in broken lines in FIG. 5. More specifically, the housing member is a unitary part, preferably of cast, non-rusting metal and includes a body 16 (FIG. 3) which includes an elongated flat plate-like portion 17. A pair of upstanding laterally spaced walls 18 and 19 extend upwardly from the plate-like portion 17 along lateral edges thereof. The length of the walls 18 and 19 are less than the overall length of the plate-like portion 17 so as to define a region 21 at each of the opposite longitudinal ends of the plate-like portion 17 for facilitating an attachment of the body 16 to a supporting member 11. Further details of the region 21 will be set forth hereinbelow. The wall 18 extends frontwardly from the plate-like portion 17 and has at its frontmost edge an inwardly extending flange 22. Similarly, the wall 19 extends frontwardly from the plate-like portion 17 and has at its frontmost edge an inwardly extending flange 23 which is coplanar with the flange 22. As shown in FIG. 6, the cross-sectional shape of the channel 24 defined by the plate-like portion 17, the generally L-shaped walls 18, 22 and 19, 23 and the gap between the mutually adjacent edges of the flanges 22 and 23 define a generally T-shape. The inwardly facing surfaces of the L-shaped walls 18, 22 and 19, 23 are generally straight and are each oriented parallel to the longitudinal axis 26 (FIG. 3) of the body 16. Each of the L-shaped walls 18, 22 and 19, 23 has an inwardly extending step 27 and 28, respectively, forming an abutment at one end of the T-shaped channel 24. In this particular embodiment, the body 16 is oriented as illustrated in FIG. 3 on a supporting member 11 so that the steps 27 and 28 are each located at the lower end of the T-shaped channel 24. It is to be recognized that it is not absolutely necessary that the steps 27 and 28 be located at the bottom or lower end of the T-shaped channel 24. If the body 16 were oriented so that it was at a right angle to that depicted in FIG. 3, the steps 27 and 28 would be merely at one end of the T-shaped channel 24. The end of the T-shaped channel 24 remote from the steps 27 and 28 is open and unobstructed by any structure on the body 16.

A plurality of internally threaded holes 29 are provided in each of the flanges 22 and 23 as shown in FIG. 3. In this particular embodiment, two internally threaded holes 29 are provided in the flanges 22 and 23. Each internally threaded hole 29 is adapted to receive therein an externally threaded set screw 31. The set screws each have a screwdriver receiving recess opening frontwardly of the body 16 with the opposite end of the set screws each extending into the T-shaped slot 24.

Each of the regions 21 has a hole 32 extending therethrough in the central portion thereof, that is, approximately midway between the longitudinal end of the body 16 and the longitudinal ends of the walls 18, 22 and 19, 23. Laterally of the holes 32 are provided slanted surfaces 33 which slant from the holes 32 toward the rear of the body 16, as best illustrated in FIG. 6. The slanted surfaces 33 provide the requisite transition from a generally flat surface encircling the hole 32 and an edge of the body 16 to facilitate a proper guiding of a flexible banding 13. If desired, a ridge 34 can be provided at the longitudinal ends of the body 16 to define a small end wall so that the slanted surfaces 33, the flat surface encircling the holes 32, the ends of the L-shaped walls 18, 22 and 19, 23 and the small end wall 34 each define a flexible band receiving track 36.

The rear surface of the body 16 has an indentation 37 therein as shown in FIG. 6. This indentation facilitates the reception of a support member 11 which has an exterior surface conforming at least in part to the contour of the indentation 37. The rear surface also has a pair of spaced flat surface portions 38 to facilitate a supporting of the body 16 on a supporting member whose surface is generally flat and planar.

The banner support assembly 10 also includes a holder member 41. The holder member 41 is generally T-shaped having a stem 42 and a cross piece 43. The stem, in this particular embodiment, is cylindrical in cross section. The cross piece 43, on the other hand, is generally rectangular in shape and is comprised of a plate-like portion 44 having the stem 42 protruding from one wall and raised runners 46 protruding from a wall of the plate-like portion 44 opposite the stem 42, which runners are adjacent lateral edges of the plate-like portion 44. A recess 47 is defined between the raised runners 46 so as to facilitate the runners 46 straddling a fastening bolt 14 utilized for securing the body of the housing member 12 to a supporting member. In other words, the depth of the recess 47 is sufficient to provide the requisite clearance for the head 48 of the bolt 14 as the holder member 41 is moved into and out of the open end of the T-shaped channel 24. In order for this to be possible, the raised runners must be oriented so as to extend parallel to the axis 26 of the body 16. The exterior surfaces of the cross-piece 43 on the holder member 41 are generally flat and extend parallel to the interior facing surfaces of the generally L-shaped walls 18, 22 and 19, 23. Further, the thickness of the plate-like portion 44 is generally just slightly less than the spacing between the plate-like portion 17 of the body 16 and the inwardly facing surface on the flanges 22 and 23. As a result, the raised runners 46 slide along the surface of the plate-like portion inside the T-shaped channel 24.

Figure 5:
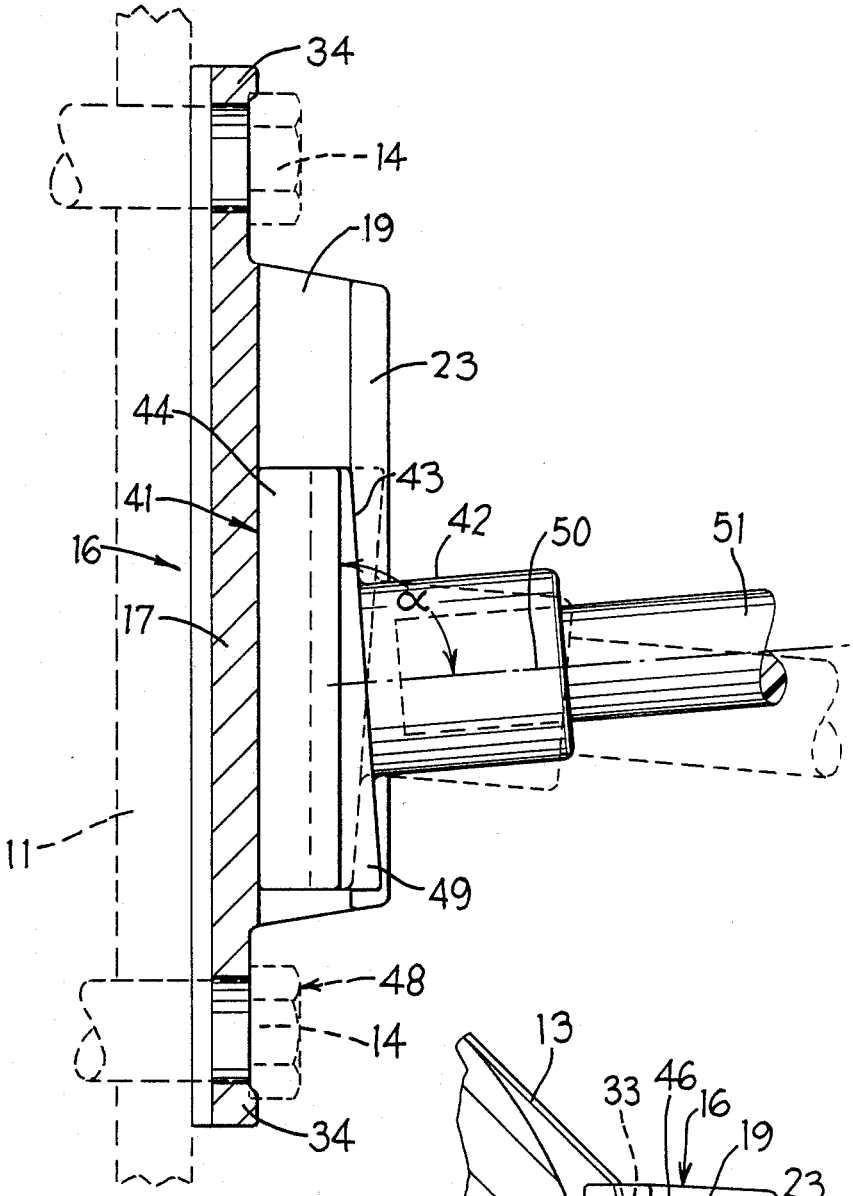
FIG. 5 is a central longitudinal sectional view taken along the line V-V of FIG. 3 and with a holder member received in a channel provided on the housing member.
Figure 6:
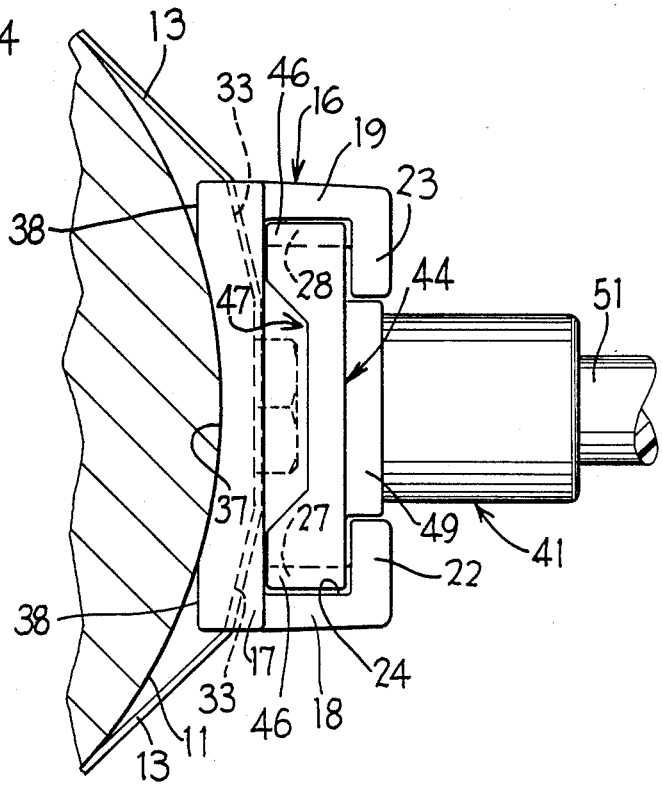
FIG. 6 is an enlarged top view of the banner support assembly.

As is shown in FIG. 5, a wedge shaped section 49 is, in this particular embodiment, provided between the plate-like portion 44 of the cross piece 43 and the cylindrically shaped stem 42. The wedge shaped section 49 causes the axis 50 of the stem 42 to extend at an angle to the central longitudinal axis of the plate-like portion 44. The angle, in this particular embodiment, is the acute angle $\alpha$ illustrated in FIG. 5. Of particular interest in this particular embodiment is the angle $\alpha$ when the holder member 41 is in the position illustrated in FIG. 5. If, for example, the holder member 41 were removed from the T-shaped channel 24 and inverted and reinserted into the open end of the T-shaped channel 24, the angle $\alpha$ would be inverted and the stem 42 would extend downwardly at an acute angle $\alpha$, such as schematically depicted in broken lines in FIG. 5.

The stem 42 has an opening in the free end thereof into which is received an elongated and elastically flexible wand 51. In this particular embodiment, the wand is cylindrical in cross section and is made of a polymer coated fiberglass material. Further, the length of the wand is at least equal to and preferably greater than the width of a banner 52 which is to be supported thereby.

OPERATION

Although a particular preferred embodiment of the invention has been described above in sufficient detail so as to be readily understood by those skilled in the art, the following will be a brief discussion of the operative characteristics of the invention to facilitate a further understanding thereof.

Figure 2:
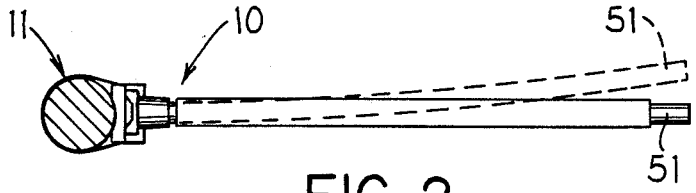
FIG. 2 is a top view of the banner support assembly.

When it is desired to display a banner 52, a banner support assembly 10 is utilized in association therewith. A pair of housing members 12 are positioned in a spaced relation on the supporting member 11, such as in a vertically spaced relation on a pole illustrated in FIG. 1. The support assembly 10 may be fastened to the pole by means of a flexible strapping 13 or by means of a bolt 14. If flexible strapping is utilized, such as is shown in FIGS. 2 and 6, care is to be taken to orient the housing members a prescribed distance apart so as to locate the vertically spaced flexible wands 51 adjacent the housing members 12 at a distance equal to the spacing between the sleeve-like openings 53 in the longitudinal ends of the banner 52. After both housing members have been securely fastened to the supporting member 11, and at the prescribed distance apart, a holder member 41 is inserted into the T-shaped channel 24 of the uppermost housing member 12. Thereafter, the uppermost sleeve-like opening 53 is slid onto the wand 51 until the edge of the banner closest to the pole is oriented closely adjacent thereto. Thereafter, the wand of a holder member 41 that is to be operatively coupled to the lowermost housing member 12 is slid into the sleeve-like opening 53 in the lower portion of the banner 52. Thereafter, the cross piece 43 is slid into the T-shaped channel 24 in the housing member 12. Force is applied to the lower portion of the banner to draw it taut. Once the banner is rendered taut, the set screws 31 are tightened into engagement with the cross pieces of both holder members so that the wands 51 will be correctly positioned to hold the banner in a displaying position.

If desired, the wands can extend at an angle $\alpha$ which is 90° . In this instance, both wands will be normally parallel to one another when installed on the supporting member 11. In a further embodiment of this invention, the angle $\alpha$ is an acute angle, such as about 80° to 85° , preferably 85° . Thus, when the cross piece of the upper holder member is inserted into the T-shaped channel 24 and with the holder member 41 oriented so that the acute angle $\alpha$ is inclined upwardly away from the housing member 12, the wand 51 will have an initial position illustrated in broken lines in FIG. 1. Similarly, if the lower holder member 41 is inserted into the T-shaped channel of the lower housing member 12 with the angle $\alpha$ being inclined downwardly, such as the broken line position illustrated in FIG. 1, both wands 51 will initially diverge away from one another. Thereafter, the uppermost wand 51 will be inserted into the sleeve-like opening at the upper end of the banner 52 and drawn onto the wand 51 so that the vertically upright edge of the banner closest the supporting member 11 will be oriented closely adjacent thereto. Thereafter, the lower wand will be inserted into the lowermost sleeve-like opening in the banner 12 and thereafter the cross piece 43 inserted into the T-shaped channel. Force is then applied to the lower wand 51 and lower end of the banner 52 to draw it taut. This will generally cause the wands to both be flexed to the horizontally aligned or parallel position such as is illustrated in solid lines in FIG. 1. When this position is achieved, the set screws 31 are tightened into tight engagement with the cross pieces 43 of the holder members to securely hold the holder members into the T-shaped channels.

Lastly, a cord, nylon cable tie or wire 54 is inserted through the grommetted holes 56 in the banner, which holes are shown to be two in number, and wrapped or otherwise secured to the supporting member so as to prevent the banner from slipping off the wands.

In the later embodiment, the edge of the banner closest the supporting member 11 will not be as taut as the edge remote therefrom. The tautness of the banner along the outboard edge will prevent the banner from flapping in winds of sufficient speeds to cause such to normally happen. In addition, wind loads applied to the banner will cause the wands to flex from the solid line position illustrated in FIG. 2 toward the broken line position so as to spill the air from the banners and enhance a protection of the integrity of the securement of the banner support assembly to the supporting member.

An important facet of the invention disclosed herein is that essentially two components are needed in order to formulate a banner support assembly. That is, the two housing members 12 can be identical to one another as can the holder members 41. If the wands 51 are to diverge away from one another as illustrated in FIG. 1, identical holder members can still be utilized provided a wedge shaped section 49 causes the wand 51 to extend away from the longitudinal axis of the T-shaped channel and the plate-like portion 44 at an acute angle $\alpha$. All that is thereafter required is to orient the holder member right side up to cause the wand to extend upwardly away from the housing member 12 or upside down to cause the wand to extend downwardly away from the housing member 12. As a result, a minimum of parts are required in inventory to meet the objective of the present invention.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A banner support assembly adapted to be mounted on a supporting member for purposes of engaging and holding taut an elongated banner having sleeve-like openings in the opposite longitudinal ends thereof, said banner support assembly comprising:

first and second housing members each having an elongated body with an elongated T-shape channel opening outwardly of said body along a front face and at at least one end thereof, said T-shaped channel having an abutment means at the other end of said channel, said first and second housing members being adapted to be mounted a prescribed distance apart on said supporting member and with each longitudinal axis of each T-shaped channel being axially aligned and with said openings in said at least one end facing in the same direction, each of said T-shaped channels being defined by straight inwardly facing walls which are each oriented parallel to said longitudinal axis;

first and second holder members each having a generally T-shaped cross section conformed to said cross sectional shape of said T-shaped channels and being adapted to be received in a respective one of said T-shaped channels through said openings in said at least one end thereof, each of said holder members having at least first and second ends with a selected one thereof adapted to rest against a respective one of said abutment members, said T-shaped cross section of said holder members being defined by outwardly facing surfaces extending parallel to said straight inwardly facing walls of said T-shaped channels;

an elongated, elastically flexible wand fixedly secured to each holder member and having a longitudinal axis thereof oriented to extend at an angle to said longitudinal axis of said T-shaped channel when one of said first and second ends of said holder member abuts said abutment member, each of said wands extending away from a part of a respective one of said T-shaped holder members that extends through said opening in said front face of said housing member, said longitudinal axis of each wand being oriented on a respective holder member to lie within a common plane with each other, said first holder member being received in a T-shaped channel in said first housing member with said first end thereof abutted against an abutment member in said first housing member, said second holder member being received in a T-shaped channel in said second housing member with at least one of said first and second ends thereof abutted against an abutment member in said second housing member, said wands each being adapted to be received into a selected one of the two sleeve-like openings in said banner, the length of said banner being generally equal to a spacing between said wands whereat said wands are joined to said holder members when said holder members both abut said abutment members.

2. The banner support assembly according to claim 1, wherein said first and second holder members and connected wands form identical structures.

3. The banner support assembly according to claim 1, wherein fastening means are provided for securing said holder members to a respective one of said housing members.

4. The banner support assembly according to claim 1, wherein said housing members each include mounting means for facilitating a fixed mounting to said supporting member.

5. The banner support assembly according to claim 4, wherein said supporting member is a pole; and wherein said mounting means includes a pair of spaced straps adapted to encircle said pole and said housing member to clamp said housing member between said straps and said pole, said straps being received in spaced tracks on said housing member.

6. The banner support assembly according to claim 5, wherein a side of said housing member remote from said front face is conformed in shape to the general exterior shape of said pole.

7. The banner support assembly according to claim 4, wherein said mounting means includes means defining a pair of holes in said housing member and an elongated fastener member with an enlarged head received in said hole to facilitate a clamping of said housing member between said supporting member and said enlarged head on said fastener member.

8. The banner support assembly according to claim 7, wherein an axis of said fastener member intersects said longitudinal axis of said T-shaped channel; and wherein each of said holder members includes an enlarged head receiving recessed portion on a side thereof remote from said wand to facilitate a movement of said holder member into and out of said T-shaped channel without said enlarged head on said fastener member interfering with said movement.

9. The banner support assembly according to claim 1, including means defining plural grommetted holes in said banner and elongated and a fastener means adapted to be received through said grommetted holes and connected to said supporting member to prevent said banner from slipping off the free end of said wands.

10. The banner support assembly according to claim 1, wherein said angle is an acute angle; and wherein said second end of said holder member abuts said abutment member in said second housing thereby causing said wands to diverge away from each other, whereby said wands must be flexed toward each other to a generally parallel condition when said holder members both abut said abutment members, the elastically flexible characteristic of said wands causing said banner to be held taut therebetween.

11. The banner support assembly according to claim 10, wherein said elastically flexible characteristic of said wands cause at least one edge of said banner most remote from said holder member to be held more taut than the other edge closest to said holder member.

* * * * *